United States Patent [19]

Borginon et al.

[11] 4,053,315

[45] Oct. 11, 1977

[54] PHOTODEVELOPABLE SILVER HALIDE MATERIAL

[75] Inventors: Hendrik Alfons Borginon, Mortsel; Willy Joseph Vanassche, Kontich, both of Belgium

[73] Assignee: AGFA-GEVAERT, N.V., Mortsel, Belgium

[21] Appl. No.: 495,815

[22] Filed: Aug. 8, 1974

[30] Foreign Application Priority Data

Sept. 17, 1973 United Kingdom ..... 43540/73

[51] Int. Cl.[2] ..... G03C 5/24; G03C 1/84

[52] U.S. Cl. ..... 96/63; 96/84 UV; 96/84 R; 96/85; 96/67; 96/94 R; 96/107; 96/108; 96/110; 96/120; 96/27 E

[58] Field of Search ..... 96/27 E, 107, 108, 110, 96/84 R, 84 UV, 120, 85, 94 R, 67, 63

[56] References Cited

U.S. PATENT DOCUMENTS

| | | | |
|---|---|---|---|
| 3,364,032 | 1/1968 | Jones | 96/107 |
| 3,486,901 | 12/1969 | Karlson | 96/109 |
| 3,531,287 | 9/1970 | Salesin | 96/84 R |

FOREIGN PATENT DOCUMENTS

| | | | |
|---|---|---|---|
| 1,123,234 | 8/1968 | United Kingdom | 96/84 R |
| 1,163,899 | 9/1969 | United Kingdom | 96/84 R |

*Primary Examiner*—Won H. Louie, Jr.
*Attorney, Agent, or Firm*—A. W. Breiner

[57] ABSTRACT

Direct-print images of improved stability against prolonged light-exposure are obtained in a photodevelopable element by spectrally sensitizing the photodevelopable emulsion, providing in the emulsion layer or a superposed layer a compound absorbing radiation in the inherent sensitivity range of the silver halide, and effecting image-wise exposure with radiation comprising light of the spectral range for which the silver halide has been spectrally sensitized.

18 Claims, No Drawings

PHOTODEVELOPABLE SILVER HALIDE MATERIAL

The present invention relates to photodevelopable radiation-sensitive silver halide elements of improved stability.

It is known that a visible image may be obtained without chemical treatment by exposing a radiation-sensitive silver halide emulsion layer to ultra-violet and/or visible light by the so-called print-out process which involves the image-wise photolysis of silver salts. However, relatively prolonged exposures are required for producing print-out images and, moreover, such images are quite unstable. The images are not fixed and the background density prints out when exposed to room-light.

For recording events which occur in rapid sequence such as oscillograph recording a high effective emulsion speed is required and therefore, it is now usual for the radiation-sensitive layer to be a photodevelopable silver halide emulsion layer. Photodevelopable emulsions for direct-recording are radiation-sensitive emulsions in which a visible image can be obtained after an image-wise exposure to light of relatively high intensity has been initially utilized to form a latent image, by an additional exposure to radiation of relatively low intensity such as diffuse daylight or artificial light. The secondary exposure, also called latensification, is an overall exposure including exposing the areas in which the initial latent image was formed as well as the surrounding background to an additional amount of radiation.

The print-out and direct-print processes are very simple in that no wet processing and subsequent drying are necessary. However, print-out images and images obtained by photodevelopment are not stable to prolonged exposure to further viewing light; the image density usually decreases and the background density increases so that the density difference between background and image areas decreases as further exposure occurs.

Many proposals have been made in order to improve the stability of images produced according to the above techniques by protecting the images produced against further action of light.

In British Pat. No. 1,123,234 it has been proposed to improve the stability of a photographic record having a visible image formed by photodevelopment of a latent image, by spraying on the image-containing layer a coating of a film-forming binder containing a dye absorbing light to which the layer is sensitive.

According to British Pat. No. 1,163,899 photodeveloped images of improved stability against further light-exposure are obtained by the use of a photodevelopable material comprising over the radiation-sensitive emulsion layer a colloid layer containing a mordant and by treating the said colloid layer, after photodevelopment, with a solution of an U.V.-absorbing compound or dye whereby the dye is mordanted in the said colloid layer and absorbs actinic radiation.

It has also been proposed e.g. in U.S. Pat. No. 3,498,789 to provide over the print-out or direct-print emulsion layer a colloid layer containing a dye precursor, which by treatment with an appropriate solution, e.g. an acid or base solution, after photodevelopment, is converted into a dye absorbing actinic radiation.

All of the above proposals for improving the stability of print-out and direct-print images have the disadvantage of requiring additional wet-treatment and subsequent drying operations.

In accordance with the present invention, a radiation-sensitive direct-print silver halide photographic element is provided by means of which direct-print images of improved stability can be formed without it being necessary to subject the element to a supplemental treatment after the formation of the visible image.

The photographic element of the invention comprises a support carrying a radiation-sensitive silver halide emulsion layer wherein the emulsion layer is a direct-print photodevelopable silver halide emulsion layer containing at least one spectrally sensitizing dye to provide an extra-range of sensitivity in the green and/or red regions of the spectrum; and at least one compound absorbing radiation in the inherent sensitivity range of the silver halide is or are present in the silver halide emulsion layer and/or in a layer coated over the silver halide layer, so as to be effective for protecting any photodeveloped image, when formed in said element from deterioration by prolonged exposure to light.

In the formation of direct-print images of improved stability using a photographic element according to the present invention, the initial image-wise exposure to form a latent image is to radiation comprising light of the spectral range for which the silver halide has been spectrally sensitized e.g. exposure by means of high pressure mercury vapour lamps, xenon lamps and tungsten lamps. Photodevelopment of the latent image may occur e.g. by means of ordinary daylight or office lighting, photoflood lamps as commonly used in photography, etc.

A large variety of dyes are known for spectrally sensitizing light-sensitive silver halide. They include cyanines, merocyanines, complex (trinuclear) cyanines, complex (trinuclear) merocyanines, styryls, hemicyanines and oxonol dyes for which there can be referred to F.M. Hamer in "The cyanine dyes and related compounds" (1964). It is preferred to use dyes that are rapidly and completely bleached on photodevelopment. Particularly useful are the imidacarbocyanines of British Pat. application No. 39969/70 in which at least one of the benzo-rings carries one or more substituents characterized by a Hammet constant of at least 0.25, nitro being excluded. These imidacarbocyanines can be represented by the following general formula:

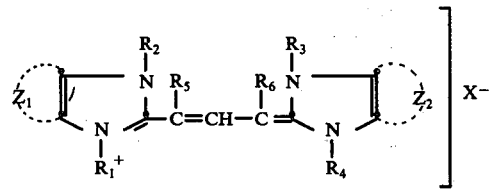

wherein:

each of $Z_1$ and $Z_2$, the same or different, stands for the atoms necessary to complete a fused-on benzene nucleus or substituted benzene nucleus, at least one of $Z_1$ and $Z_2$ representing the atoms necessary to complete a fused-on benzene nucleus carrying one or more substituents characterized by a Hammet constant $\sigma p$ of at least 0.25, nitro being excluded, each of $R_1$, $R_2$, $R_3$ and $R_4$, the same or different, stands for a saturated or unsaturated an aliphatic group, and a cycloaliphatic group, or an aromatic group (any one or more of which groups may be substituted), each of $R_5$ and $R_6$ stands for hydrogen or $R_5$ together with $R_2$ and/or $R_6$ together with $R_3$ represent the atoms necessary to close a fused on ring, and $X^-$ stands for an anion but does not exist when $R_1$, $R_2$, $R_3$ or $R_4$ comprises an anionic group.

Representative examples of suitable imidacarbocyanines are listed in the following table.

Table

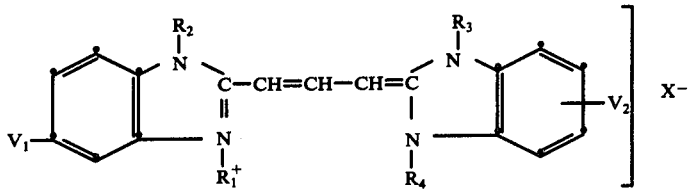

| Dye | $V_1$ | $R_1$ | $R_2$ | $V_2$ | $R_3$ | $R_4$ | X |
|---|---|---|---|---|---|---|---|
| 1 | $SO_2CH_3$ | $C_2H_5$ | $C_2H_5$ | 5-$SO_2CH_3$ | $C_2H_5$ | $C_2H_5$ | I |
| 2 | $SO_2CHF_2$ | $C_2H_5$ | $C_2H_5$ | 5-$SO_2CHF_2$ | $C_2H_5$ | $C_2H_5$ | I |
| 3 | $SO_2CF_3$ | $C_2H_5$ | $C_2H_5$ | 5-$SO_2CF_3$ | $C_2H_5$ | $C_2H_5$ | I |
| 4 | $SO_2CF_3$ | $C_2H_5$ | $(CH_2)_4-SO_2N.COCH_3$ | 5-$SO_2CF_3$ | $C_2H_5$ | $(CH_2)_4SO_2NHCOCH_3$ | — |
| 5 | $SO_2CF_2CHFCl$ | $C_2H_5$ | $C_2H_5$ | 5-$SO_2CF_2CHFCl$ | $C_2H_5$ | $C_2H_5$ | I |
| 6 | $SO_2F$ | $C_2H_5$ | $C_2H_5$ | 5-$SO_2F$ | $C_2H_5$ | $C_2H_5$ | I |
| 7 | $SO_2NHC_2H_5$ | $C_2H_5$ | $C_2H_5$ | 5-$SO_2NHC_2H_5$ | | | |
| 8 | $SO_2N(CH_3)_2$ | $CH_3$ | $CH_3$ | 5-$SO_2N(CH_3)_2$ | $CH_3$ | $CH_3$ | I |
| 9 | $SO_2N(CH_2-CH_2)_2$ | $CH_3$ | $C_2H_5$ | 5,6-diCl | $C_2H_5$ | $C_2H_5$ | I |
| 10 | $SO_2N(CH_2-CH_2)_2$ | $C_2H_5$ | $C_2H_5$ | 5-$SO_2N(CH_2-CH_2)_2$ | $C_2H_5$ | $C_2H_5$ | I |
| 11 | $-COOC_2H_5$ | $C_2H_5$ | $C_2H_5$ | 5-$COOC_2H_5$ | $C_2H_5$ | $C_2H_5$ | I |
| 12 | $-COCH_3$ | $C_2H_5$ | $C_2H_5$ | 5-$COCH_3$ | $C_2H_5$ | $C_2H_5$ | I |
| 13 | CN | $C_2H_5$ | $C_2H_5$ | 5-CN | $C_2H_5$ | $C_2H_5$ | I |
| 14 | CN | $C_2H_5$ | $(CH_2)_2OCOCH_3$ | 5-CN | $C_2H_5$ | $(CH_2)_2OCOCH_3$ | Br |
| 15 | CN | $C_2H_5$ | $(CH_2)_4SO_2NHCOCH_3$ | 5-CN | $C_2H_5$ | $C_2H_5$ | Br |
| 16 | $SO_2CH_2Cl$ | $CH_3$ | $C_2H_5$ | 5-$SO_2CH_2Cl$ | $CH_3$ | $C_2H_5$ | I |
| 17 | $SO_2N(CH_2-CH_2)_2$ | $CH_3$ | $C_2H_5$ | 5-$SO_2N(CH_2-CH_2)_2$ | $CH_3$ | $(CH_2)_3SO_3^-$ | — |
| 18 | $SO_2N(CH_2-CH_2)_2$ | $CH_3$ | $(CH_2)_3SO_3^-$ | 5-$SO_2N(CH_2-CH_2)_2$ | $CH_3$ | $(CH_2)_3SO_3^-$ | — |
| 19 | $SO_2N(CH_2-CH_2)_2CH_2$ | $CH_3$ | $CH_3$ | 5-$SO_2N(CH_2-CH_2)_2CH_2$ | $CH_3$ | $CH_3$ | I |
| 20 | $SO_2N(CH_2-CH_2)_2CH_2$ | $CH_3$ | $(CH_2)_3SO_3^-$ | 5-$SO_2N(CH_2-CH_2)_2CH_2$ | $CH_3$ | $C_2H_5$ | — |
| 21 | $SO_2CH_2Cl$ | $C_2H_5$ | $C_2H_5$ | 5-$SO_2CH_2Cl$ | $C_2H_5$ | $C_2H_5$ | I |
| 22 | $CF_3$ | $C_2H_5$ | $C_2H_5$ | $C_2H_5$ | $C_2H_5$ | $C_2H_5$ | I |
| 23 | $SOCF_3$ | $C_2H_5$ | $C_2H_5$ | $SOCF_3$ | $C_2H_5$ | $C_2H_5$ | I |

Other very suitable spectrally sensitizing dyes are the merocyanines and cyanines described in U.S. Pat. No. 3,287,136.

The spectrally sensitizing compounds used in the direct-print silver halide emulsion may be present in amounts varying between very wide limits. Generally they are used in amounts comprised between about 1 mg and about 1000 mg, preferably between about 50 mg and about 500 mg per mole of silver halide.

The choice of the light-absorbing compound is governed by its absorption characteristics. It should absorb strongly in the region of maximum inherent sensitivity of the silver halide; in many cases 410–420 nm. The light-absorbing compounds used in the direct-print element of the present invention are dyes and/or U.V.-absorbers absorbing radiation in the range from about 300 nm to about 490 nm, preferably in the range from about 340 nm to about 460 nm. Such light-absorbing compounds therefore do not have to be converted to a light-absorbing or more light-absorbing form by a chemical conversion step. The need to use a liquid processing step for stabilising the image is therefore avoided. The said light-absorbing compounds should not or only to a very slight extent absorb radiation of a wavelength longer than the 460–490 nm wavelength range because they would reduce the sensitivity of the direct-print silver halide for latent image formation. If desired, a mixture of light-absorbing compounds may be used in the present invention.

Compounds absorbing radiation of the wavelength region between about 300 nm and about 490 nm are well known. They can be selected e.g. from dyes known for use in silver halide photography as antihalation dyes or filter dyes (cfr. U.S. Pat. Nos. 3,493,375 — 3,540,887 — 3,544,325 — 3,615,546 — 3,653,905 and 3,687,670 and U.S. Pat. applications Ser. Nos. 144,233 and 144,251), optical brightening agents including stilbene, triazine, oxazole and coumarin brightening agents, etc.

The following is a non-limitative list of light-absorbing compounds suitable for the purpose of the present invention.

1. copolymers comprising n-butylacrylate units and units of one of the following formulae:

a)

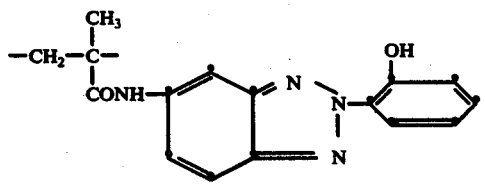

b)

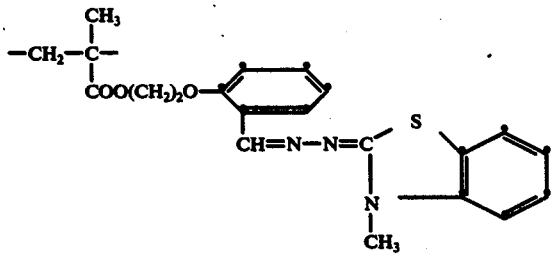

c)

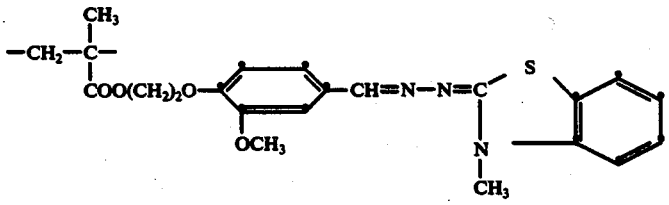

prepared as described in U.S. Pat. application Ser. Nos. 144,233 and 144,251.

2.

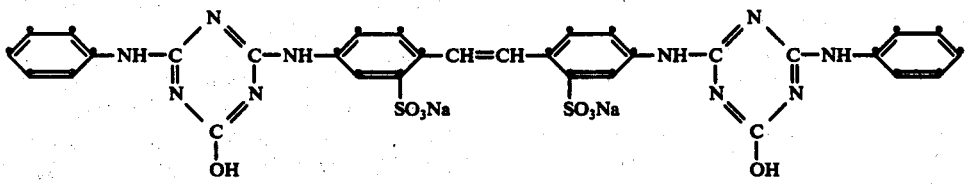

3.

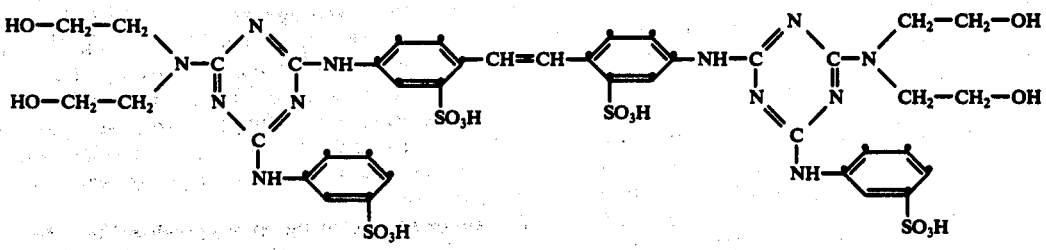

4.

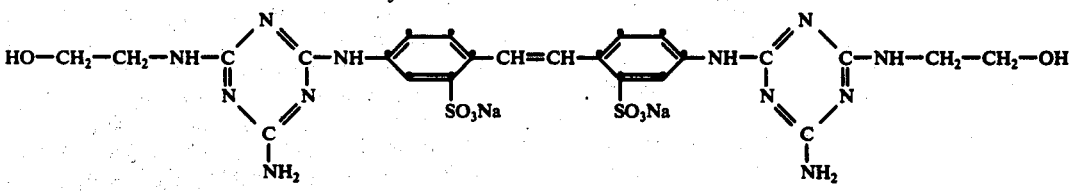

-continued

5.

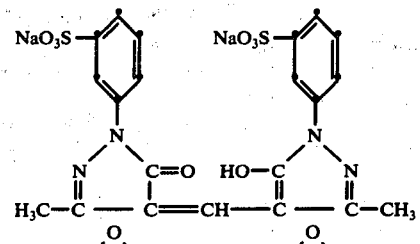

6.

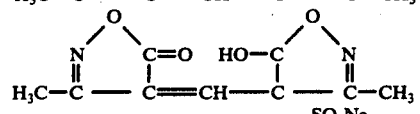

7.

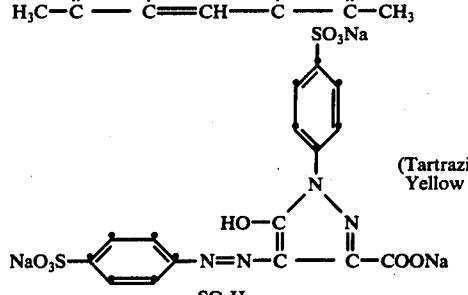

(Tartrazine, C.I. Acid Yellow 23 - C.I. 19 140)

8.

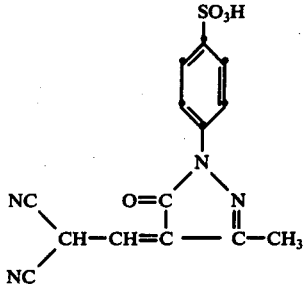

9.

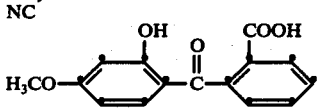

10. Sulphonated quinoline yellow (C.I. Acid Yellow 3 - C.I. 47 005)

It is also possible to use mixtures of the above compounds for example a mixture of compounds 9, 10 and 1*b*, a mixture of compounds 4 and 1*c*, etc.

The light-absorbing compounds used in the direct-print silver halide material may be present in amounts varying between very wide limits which depend on the particular compounds used. Usually they are used in amounts between about 10 mg and about 1000 mg per sq.m.

In order to prevent diffusion of the light-absorbing compound during coating of the layer incorporating the compound, it may be advantageous to use the compound together with mordanting agents well-known in silver halide photography.

Both the spectrally sensitizing dye and the light-absorbing compound can be incorporated into the coating composition of the layer or layers in which they are intended to be present, according to any suitable technique known for incorporating such compounds or dyes in photographic elements. They can be incorporated from solutions or dispersions in water, water-miscible solvents e.g. alcohols such as methanol or water-immiscible solvents. The solvents should of course be without deleterious effect on the photodevelopable material.

The spectrally sensitizing dyes of use according to the present invention can be incorporated in the emulsion at any stage of emulsion preparation and should be uniformly distributed throughout the emulsion. They are preferably incorporated just before coating of the emulsion on a support.

As already noted above, the light-absorbing compound may be present in the direct-print silver halide layer or in a layer coated over the silver halide layer, the first embodiment being preferred in that no supplemental layer is required.

When the light-absorbing compound is to be present in a layer coated over the silver halide layer, the binding agent of the layer may be any of the hydrophilic natural or synthetic colloids known for use in silver halide photography e.g. gelatin, albumin, zein, agar-agar, cellulose derivatives and synthetic resins e.g. polyvinyl compounds such as polyvinyl alcohol. Mixtures of such colloids can also be used e.g. mixture of gelatin and acrylate-acrylic acid copolymers. The binding agent need not necessarily be water-permeable and hydrophobic binders may be used when it is not the intention to reinforce the photodeveloped image by wet development and fixing.

The silver halides of the photodevelopable radiation-sensitive silver halide emulsions of the present invention are those customarily used in direct-print photographic materials and include silver bromide, silver bromoiodide, silver chloride, silver chlorobromide and silver chlorobromoiodide emulsions. Silver chlorobromide and silver bromide emulsions which may comprise minor amounts of silver iodide, preferably not more than 5 mole % relative to the total amount of silver halide, are favoured.

The direct-print radiation-sensitive emulsion is preferably of the type forming latent images predominantly inside the silver halide grains. A silver halide emulsion that mainly or entirely forms an internal latent image and not or only to a little extent an external latent image is an emulsion in which only a few or no exposed grains at all are developable into silver by a developing solution that cannot act as a developer for a latent image inside the grains i.e. a so-called "surface" developer, such as:

| | |
|---|---|
| p-hydroxyphenyl glycine | 10 g |
| sodium carbonate (cryst.) | 100 g |
| water to | 1000 ccs |

and wherein the exposed grains are well developable to silver by a developing solution that acts as a developer for a latent image inside the grains i.e. a so-called "internal" developer such as the following solution:

| | |
|---|---|
| hydroquinone | 15 g |
| monomethyl-p-aminophenol sulphate | 1.5 g |
| sodium sulphite (anhydrous) | 50 g |
| potassium bromide | 10 g |
| sodium hydroxide | 25 g |
| sodium thiosulphate (cryst.) | 20 g |
| water to | 1000 ccs |

By a silver halide emulsion that mainly forms an internal latent image and little external latent image there is more particularly meant a silver halide emulsion, a test layer of which upon exposure to a light intensity scale for a fixed time between 1/100 and 1 sec. and development for 3 min. at 20° C in the above "internal" developer, exhibits a maximum density at least five times the maximum density obtained when an identical test layer of the said silver halide emulsion is equally exposed and then developed for 4 min. at 20° C in the above "surface" developer.

Silver halide emulsions that meet the above requirement are generally not or only slightly chemically ripened silver halide emulsions, since the extent of the surface latent image-forming capability increases with the degree of chemical ripening. After precipitation of the silver halide grains the emulsion may or may not be, but preferably is washed.

The emulsions may be prepared according to all known and conventional techniques of direct-print emulsion preparation. A method according to which emulsions are prepared and which has proven to be particularly suitable for the purpose of the invention is the so-called conversion method according to which an emulsion of a silver salt that has a higher degree of water solubility than silver bromide is converted into a silver chlorobromide or silver bromide emulsion that occasionally contains small amounts of silver iodide. This conversion is carried out preferably very slowly for instance by several consecutive steps.

Other emulsions forming mainly internal latent image and little external latent image are silver halide emulsions the silver halide grains of which are composed of a core and an outer shell of silver halide which can be prepared as described e.g. in British Pat. No. 1,011,062 and German Pat. No. 1,169,290.

Thus emulsions with high internal sensitivity can be obtained by providing in the interior of the silver halide grains centres promoting the deposition of photolytic silver which may be produced physically or chemically.

For example, it is possible to adapt the conditions of precipitation in order to form physical defects in the crystal latice. The centres can also be produced for example by physical ripening of silver halide grains in the presence of halide ions e.g. iodide and/or bromide ions or in the presence of an excess of silver ions. The centres can further be produced by carrying out precipitation of the silver halide grains in the presence of polyvalent metal ions or metal compounds, or by interrupting precipitation and chemically sensitizing the cores formed.

The light-sensitive silver halide emulsions may contain all kinds of ingredients which are generally known in the art of photo-developable emulsion preparation.

It is common practice in the preparation of photodevelopable silver halide emulsions to utilise halogen acceptors. A wide variety of compounds has been proposed for use as halogen acceptors such as N-containing halogen acceptors of the thiourea type, of the hydrazine type, throuracil, urazole and thiourazole halogen acceptors, mercapto-triazoles and mercaptotetrazoles e.g. 1-phenyl-5-mercapto-tetrazole, mercaptoimidazoles, imidazolidinethiones, mercaptotriazines, hydrazothiocarbonamide, thiosemicarbazide; further aromatic mercaptans such as thiosalicylic acid, phenylenediamines, aminophenols, hydroquinones, 3-pyrazolidones, nitriles, phenols, thiosulphates and the like halogen acceptors well-known to those skilled in the art including stannous salts such as stannous chloride. For a detailed survey of halogen acceptors suitable for use in photo-developable radiation-sensitive silver halide emulsions there can be referred to U.S. Pat. No. 3,287,137. Other suitable halogen-acceptors have been described in U.S. Pat. Nos. 3,502,471 and 3,508,921 and in British Pat. No. 1,155,958.

In order to reduce the background density and/or to increase the speed, the emulsion may comprise divalent metal compounds e.g. lead and cadmium compounds preferably water-soluble inorganic salts of lead and cadmium for instance lead acetate, lead iodide, lead nitrate, cadmium iodide, cadmium chloride, cadmium bromide and cadmium nitrate, which are added during precipitation of the silver halide grains in acidic medium or after precipitation for example prior to coating of the emulsions.

Favourable speed and background density are obtained when lead ions are occluded in the silver halide grains by carrying out silver halide precipitation in acidic medium in the presence of lead ions e.g. according to the methods described in U.S. Pat. No. 3,178,293 and cadmium compounds are added after precipitation and prior to coating.

Cadmium compounds can be added to direct-print emulsions in widely varying amounts. Usually from about 10 to about 100 g of cadmium compound are used per mole of silver halide.

If precipitation is carried out in the presence of lead ions, the lead compound may also be used in largely varying amounts. It is generally used in an amount comprised between about 0.01 g and about 10 g, preferably between 0.1 and 5 g per mole of silver halide.

The direct-print silver halide emulsion may further comprise compounds that stabilize the photodeveloped image e.g. thiocyanates such as potassium thiocyanates.

It may further be interesting, in order to obtain higher net densities and thus more contrasty images, to incorporate into the photodevelopable silver halide emulsions molecular iodine, a silver iodide sol and/or a compound which releases iodide ions in aqueous medium such as inorganic and organic iodides, organic compounds with labile iodine atom and onium chloriodates, examples of which can be found among others in U.S. Pat. Specification No. 3,502,471. The amount of iodine compound added to the emulsion may vary within wide limits. In general an amount from about 0.01 g to about 20 g, preferably from 0.1 g to 5 g per mole of silver halide is used.

It is also possible to incorporate gold salts in direct-print silver halide emulsions as described e.g. in U.S. Pat. No. 3,594,172.

All kinds of other ingredients which are generally known in the art of direct-print silver halide emulsions may be incorporated in the said emulsions e.g. hardening agents e.g. formaldehyde, coating aids, e.g. saponine, plasticizers e.g. glycerol, development accelerators, compounds that render the material resistant to wrinkling and less brittle, etc.

Gelatin is preferably used as the hydrophilic colloid binder but other colloidal materials such as colloidal albumin, cellulose derivatives and synthetic resins e.g. polyvinyl compounds or mixtures thereof with gelatin can also be used.

The photodevelopable radiation-sensitive silver halide elements according to the invention may comprise any of the wide variety of supports in accordance with usual practice.

Examples of suitable supports are paper, polyethylene-coated paper, polypropylene-coated paper, cellulose acetate film, polyvinyl acetal film, polystyrene film, polyethylene terephthalate film, films of other resinous materials, glass and metal supports. Paper supports are preferred in accordance with the present invention.

In the preparation of photodeveloped images in accordance with the present invention the radiation-sensitive silver halide element is first image-wise exposed to radiation in the spectrum range to which the silver halide layer has been sensitized to such an extent that a latent image is formed in the silver halide material but taking care that the silver halide is not caused to print-out. Broadly speaking, such an exposure can be effected with high as well as with low intensity radiation. However, the image-wise exposure mostly occurs with high-intensity actinic radiation e.g. tungsten lamps, xenon lamps and high pressure mercury vapour lamps. The image-wise exposure may occur by means of light-spots or spots of other actinic radiation (trace beam, oscilloscope traces).

The sharpness of the recorded trace or image may be further increased by a short preliminary and overall exposure of the photodevelopable radiation-sensitive material according to the invention to ordinary light, e.g. daylight, prior to exposing the material image-wise to the high-intensity radiation. Indeed, by this short preliminary exposure the gradation in the toe of the characteristic curve and the contrast or net density of the recorded trace or image are increased.

It may be advantageous in the formation of the photodeveloped images, to supply heat to the latent image containing layer before and/or during photo-development so that the recorded images become more rapidly visible. This can be done for instance by contacting the material with a hot plate, say at a temperature comprised between 80° and 200° C in the photo-development step. A probable explanation of the favourable effect of supplying heat before and/or during photodevelopment has been given by Jacobs, Phot.Sci.& Eng., Vol 5, No. 1, 1961. It would appear that by this heat treatment the propensity of the non-image or background areas to print-out i.e. to increase in density upon exposure to radiation is greatly reduced so that the intensity of the secondary exposure can be increased, without producing fog.

Some oscillographs operate according to this principle: after the latent-image exposure the material is passed over a heated plate while being overall exposed so that a visible image is produced almost immediately. By applying heat in this way when high writing speeds and thus high paper transport speeds are used it is not necessary to expose considerable lengths of material to ambient light at the same time, which would lead to a handling problem.

As is known it is possible to process direct-print silver halide elements during or after photodevelopment with developer and fixing solutions e.g. to reinforce the image and increase its permanence. Such processing may be done in the case of a material according to the present invention. A mere fixation of the photodeveloped element without a preliminary chemical development is also possible if a non-acidic fixer is used. Of course, the image-wise exposed photographic element according to the present invention may also be developed and then fixed without a photodevelopment being carried out.

If it is known that chemical processing is to be used it may be advantageous to use as light-absorbing compound a dye which is decolourized by one of the processing solutions.

The following example illustrates the present invention.

EXAMPLE

A light-sensitive photographic silver bromide emulsion of the light-developable type, i.e. that mainly forms an internal latent image and only to a little extent an external latent image was prepared by conversion of a silver chloride emulsion into a silver bromide emulsion. Said silver bromide emulsion was prepared so that an amount of silver bromide equivalent to 85 g of silver nitrate was present per kg of emulsion.

Common emulsion ingredients were incorporated into the light-developable emulsion which include cadmium bromide, a gelatine silver iodide sol, as well as halogen acceptors and coating aids. Moreover, 85 mg of the following spectral sensitizer were added per kg:

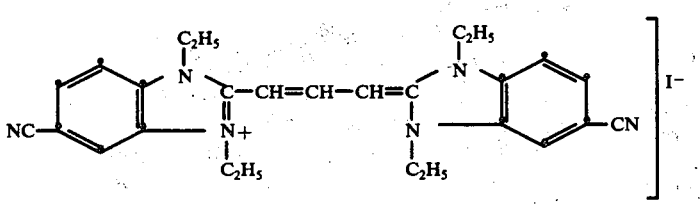

The emulsion was divided into three aliquot portions A, B and C. To emulsion portion B, 6.8 g of yellow light-absorbing compound 8 given hereinbefore were added per kg emulsion whereas to emulsion portion C, 6.8 g of yellow light-absorbing compound 5 given hereinbefore were added per kg emulsion.

The three emulsion samples were coated on conventional photographic paper supports such that an amount of silver halide equivalent to 4 g of silver nitrate was present per sq.m. of light-sensitive material.

The three light-sensitive materials obtained were subjected to the following identical successive treatments.

1. They were exposed in a flash-sensitometer "Mark VI" of Edgerton, Germeshausen and Grier for $10^{-3}$sec. through a step-wedge with a constant of 0.20.

2. The exposed materials were photo-developed for 15 min. by exposure to ordinary office fluorescent lights with a total light intensity of 240 lux whereupon the density of the image-areas ($D_{max}$) and non-image areas ($D_{min}$) were measured in a MacBeth reflection densitometer.

3. The photodeveloped materials were exposed for 15 hours to direct sunlight in such a way that the total light-intensity was about 5000 Lux.

The values for the maximum and minimum densities as well as the image discrimination ($D_{max} - D_{min} = \Delta D$) obtained directly after photodevelopment, as well as after exposure to sunlight as described above for 6 hours and 15 hours are listed in the table hereinafter. The number of the steps of the wedge that were still legible after the 15 hours is also listed in the table. This number is a measure of the sensitivity of the three emulsion samples.

Table

| Emulsion | after photodevelopment | | | after 6 hours | | | after 15 hours | | | steps after 15 hours |
|---|---|---|---|---|---|---|---|---|---|---|
| | $D_{max}$ | $D_{min}$ | $\Delta D$ | $D_{max}$ | $D_{min}$ | $\Delta D$ | $D_{max}$ | $D_{min}$ | $\Delta D$ | |
| A | 0.82 | 0.44 | 0.38 | 0.55 | 0.48 | 0.07 | 0.55 | 0.50 | 0.05 | 4 |
| B | 0.80 | 0.42 | 0.38 | 0.62 | 0.46 | 0.16 | 0.60 | 0.48 | 0.12 | 9 |
| C | 0.82 | 0.43 | 0.39 | 0.63 | 0.47 | 0.16 | 0.62 | 0.48 | 0.14 | 10 |

It clearly appears from the above results that the use of light-absorbing compounds 5 and 8 have a marked effect on the stability of the image.

We claim:

1. Photographic element comprising a support bearing a radiation-sensitive silver halide emulsion layer wherein the emulsion layer is a direct-print photodevelopable silver halide emulsion layer containing at least one spectrally sensitizing dye to provide an extra range of sensitivity in the green and/or red regions of the spectrum, and wherein at least one dye compound absorbing radiation in the inherent sensitivity range of the silver halide is or are present in the silver halide emulsion layer and/or in a superposed layer, so as to be effective for protecting a photodeveloped image, when formed in the said element, from deterioration by prolonged exposure to light.

2. Element according to claim 1, wherein the compound absorbing radiation in the inherent sensitivity range of the silver halide is present in the emulsion layer.

3. Element according to claim 1, wherein the compound absorbs radiation in the range from about 340 nm to about 460 nm.

4. Element according to claim 1, wherein the support is a paper support.

5. Element according to claim 1, wherein the silver halide emulsion is of the type forming latent images predominantly inside the silver halide grains.

6. Element according to claim 5, wherein the emulsion is formed by conversion of an emulsion of a silver salt that has a higher degree of water solubility than silver bromide into a silver chlorobromide or silver bromide emulsion that may contain small amounts of silver iodide.

7. Element according to claim 1, wherein the emulsion contains one or more halogen acceptors.

8. Element according to claim 1, wherein the emulsion contains cadmium bromide.

9. Element according to claim 1, wherein the emulsion contains molecular iodine, a silver iodide sol and/or a compound releasing iodide ions in aqueous medium.

10. Method of improving the stability of direct-print images formed by photodevelopment of an image-wise exposed photographic element comprising a support and one radiation-sensitive silver halide emulsion layer, the method precluding a special treatment after photodevelopment and comprising the steps of: spectrally sensitizing the silver halide emulsion layer for the green and/or red regions of the spectrum; providing in said silver halide emulsion layer and/or in a layer coated over the silver halide emulsion layer a dye compound absorbing radiation in the inherent sensitivity range of the silver halide; effecting image-wise exposure with radiation comprising light of the spectral range for which the silver halide has been spectrally sensitized and photodeveloping.

11. Method according to claim 10, wherein the compound absorbing radiation in the inherent sensitivity range of the silver halide is present in the emulsion layer.

12. Method according to claim 10, wherein the compound absorbs radiation in the range from about 340 nm to about 460 nm.

13. Method according to claim 10, wherein the support is a paper support.

14. Method according to claim 10, wherein the silver halide emulsion is of the type forming latent images predominantly inside the silver halide grains.

15. Method according to claim 14, wherein the emulsion is formed by conversion of an emulsion of a silver salt that has a higher degree of water solubility than silver bromide into a silver chlorobromide or silver bromide emulsion that may contain small amounts of silver iodide.

16. Method according to claim 10, wherein the emulsion contains one or more halogen acceptors.

17. Method according to claim 10, wherein the emulsion contains cadmium bromide.

18. Method according to claim 10, wherein the emulsion contains molecular iodine, a silver iodide sol and/or a compound releasing iodide ions in aqueous medium.

* * * * *